US005873541A

United States Patent [19]

Reibl et al.

[11] Patent Number: 5,873,541

[45] Date of Patent: Feb. 23, 1999

[54] MAGAZINE ARRANGEMENT FOR RECEIVING FILM CARTRIDGES

[75] Inventors: Michael Reibl, Boeblingen; Bruno Muenster, Bad Ditzenbach; Horst Schempp, Ostfildern, all of Germany

[73] Assignee: Eastman Kodak Company, Rochester, N.Y.

[21] Appl. No.: 713,303

[22] Filed: Sep. 13, 1996

[30] Foreign Application Priority Data

Sep. 23, 1995 [DE] Germany ..... 195 35 449.4

[51] Int. Cl.[6] ..... B65H 19/00

[52] U.S. Cl. ..... 242/559.3; 242/559.4; 242/560; 242/594.3

[58] Field of Search ..... 242/559, 558, 242/559.3, 559.4, 560, 594.3

[56] References Cited

U.S. PATENT DOCUMENTS

| | | | |
|---|---|---|---|
| 2,721,710 | 10/1955 | Birchler et al. | 242/559.4 |
| 3,104,847 | 9/1963 | Miller | 242/594.3 |
| 4,527,722 | 7/1985 | Strachan | 242/594.3 X |
| 4,714,210 | 12/1987 | Howell | 242/594.3 X |
| 4,863,112 | 9/1989 | Summerauer | 242/559 X |
| 5,486,081 | 1/1996 | Draghetti | 242/560 X |
| 5,523,816 | 6/1996 | Sherman, Jr. et al. . | |

FOREIGN PATENT DOCUMENTS

| | | | |
|---|---|---|---|
| 0 660 181 | 6/1995 | European Pat. Off. . | |
| 0 664 483 | 7/1995 | European Pat. Off. . | |
| 4300022 | 10/1992 | Japan | 242/559.4 |
| 530 034 | 12/1972 | Switzerland . | |

*Primary Examiner*—Donald P. Walsh
*Assistant Examiner*—William A. Rivera
*Attorney, Agent, or Firm*—Frank Pincelli

[57] ABSTRACT

A magazine arrangement for receiving multiple film cartridges, that, for processing of the filmstrips present in the film cartridges, can be attached to a processing machine. A magazine includes a cylindrical member that has chambers, arranged in a circle around the member center axis, in which the film cartridges are housed axially one above another. Each free end of the magazine is covered by two superimposed closure disks that are mounted rotatably with respect to one another about the member center axis against spring force. In this context an adapter is provided with which the magazine can be joined, in the direction of the member center axis, to a further magazine of the same shape and size; whereby the adapter has an arrangement which can be brought into engagement with the closure disks of the two magazines. With a magazine arrangement configured in this manner, film cartridges can be transferred from one magazine into another magazine, or individual defective cartridges can be separated and removed from the magazine.

16 Claims, 4 Drawing Sheets

MAGAZINE ARRANGEMENT FOR RECEIVING FILM CARTRIDGES

FIELD OF THE INVENTION

The invention concerns a magazine arrangement for receiving multiple film cartridges, that, for processing of the filmstrips present in the film cartridges, can be attached to a processing machine, a magazine consisting of a cylindrical member that has chambers, arranged in a circle around the member center axis, in which the film cartridges are housed axially one above another, and each free end of the magazine being covered by two superimposed closure disks that are mounted rotatably with respect to one another about the member center axis against spring force.

BACKGROUND OF THE INVENTION

In order to develop exposed films, the individual filmstrips are removed from the film cartridges, spliced together and, wound onto a drum, fed into the film developing machine.

The individual filmstrips are spliced together in a splicer apparatus, the filmstrips being automatically removed from the film cartridge and spliced together. After film development and production of prints, the filmstrips, the completed prints, and the associated mailing envelopes are assembled correctly at a delivery point, priced, and sent back to the customers.

To automate splicing of the filmstrips, Swiss Patent 530 034 discloses an apparatus for loading automatic film processing machines which has a motor-driven carousel that is equipped with slide-in retainers for magazines, each of which has multiple compartments for positioned receiving of one film container each. Arranged at a specific point on the rotation path of the magazines positioned on the carousel is a transport apparatus for lifting displacement of one magazine at a time, which when the magazine pivots inward automatically couples with it and moves all the magazine compartments, in stepped fashion, past a specific point for processing of the film containers.

Also proposed is an apparatus in which axially aligned chambers are configured in a cylindrical member in a circle around the member center axis, in which chambers multiple film cartridges are housed, stacked axially one above another. This apparatus is coupled to a splicer apparatus for automatic removal of the film cartridges and for processing of the filmstrips.

The disadvantage of this apparatus becomes evident when a defective film cartridge is detected in one of the chambers. In this instance the magazine must be taken off the splicer apparatus and then an entire column of film cartridges must be removed, by means of a separate auxiliary apparatus, from the chamber in question, and the defective film cartridge separated and repaired; and if this is not immediately possible, an empty cartridge must be placed at this point and the entire column put back into the chamber. Then the magazine must be reattached to the splicer apparatus.

This procedure is time-consuming and laborious, and interrupts the film processing process in an intolerable manner. If the defective film cartridge is not removed, this causes machine jams and possibly damage to the machine, the film cartridge, and not least the filmstrip, so that proper print production can no longer be guaranteed.

SUMMARY OF THE INVENTION

It is the object of the invention to create a magazine arrangement in which a defective film cartridge can be removed directly from the chamber with no need to take the arrangement off the splicer apparatus. In addition, the arrangement is to be such that film cartridges can be transferred from one magazine into another.

This is achieved, according to the invention, by the fact that an adapter is provided with which the magazine can be joined, in the direction of the member center axis, to a further magazine of the same shape and size; and that the adapter has means that can be coupled to the closure disks of the two magazines.

Preferably the invention is such that the adapter is of annular configuration, and has a height which corresponds substantially to the length of a film cartridge. The adapter consists of an upper plate and a lower plate of the same shape and size, which are rigidly interconnected on the one hand by means of a concentrically arranged web configured as a segment of a circle, and on the other hand by means of a wall forming a chamber that is open radially outward. The chamber formed by the wall has, in cross-section, the shape and size of the chambers of a magazine.

In detail, the adapter is configured so that an outward-facing central depression, into which a pivot pin mounted centeredly on the upper plate and the lower plate projects, is provided in both the upper plate and the lower plate; and that a bearing disk is arranged, rotatably about the respective pivot pin, in each depression.

Advantageously, there is also configured in each case between the web and the upper plate and the lower plate a concentrically arranged guide groove, into which an upper and a lower segment element are mounted slidingly about the member center axis.

A peg-shaped stop that extends toward the lower plate is mounted on the upper segment element; and there is provided on the same segment element a pin which passes through an elongated hole arranged concentrically in the upper plate and, when the magazine is attached, engages into the inner closure disk thereof.

Lastly a hemicylindrical counterstop, which extends towards the upper plate, is arranged rotatably on the lower segment element; and there is provided on the same segment element a pin which passes through an elongated hole arranged concentrically in the lower plate and, when the magazine is attached, engages into the inner closure disk thereof.

With the magazine arrangement according to the invention it is advantageously possible to transfer film cartridges from one magazine into another magazine. Individual defective film cartridges can also be removed from the magazine with no need to take the magazine arrangement off a splicer apparatus. This removal process will be described in further detail in the following. It is an essential feature, however, that in the event of a defective film cartridge the working procedure of splicing filmstrips must be interrupted only for a much shorter time than is the case with known apparatuses.

BRIEF DESCRIPTION OF THE DRAWINGS

Further features and advantages are evident from an embodiment of the invention depicted in the following drawings, and from the additional subclaims in which

DETAILED DESCRIPTION OF THE INVENTION

Figure 1:
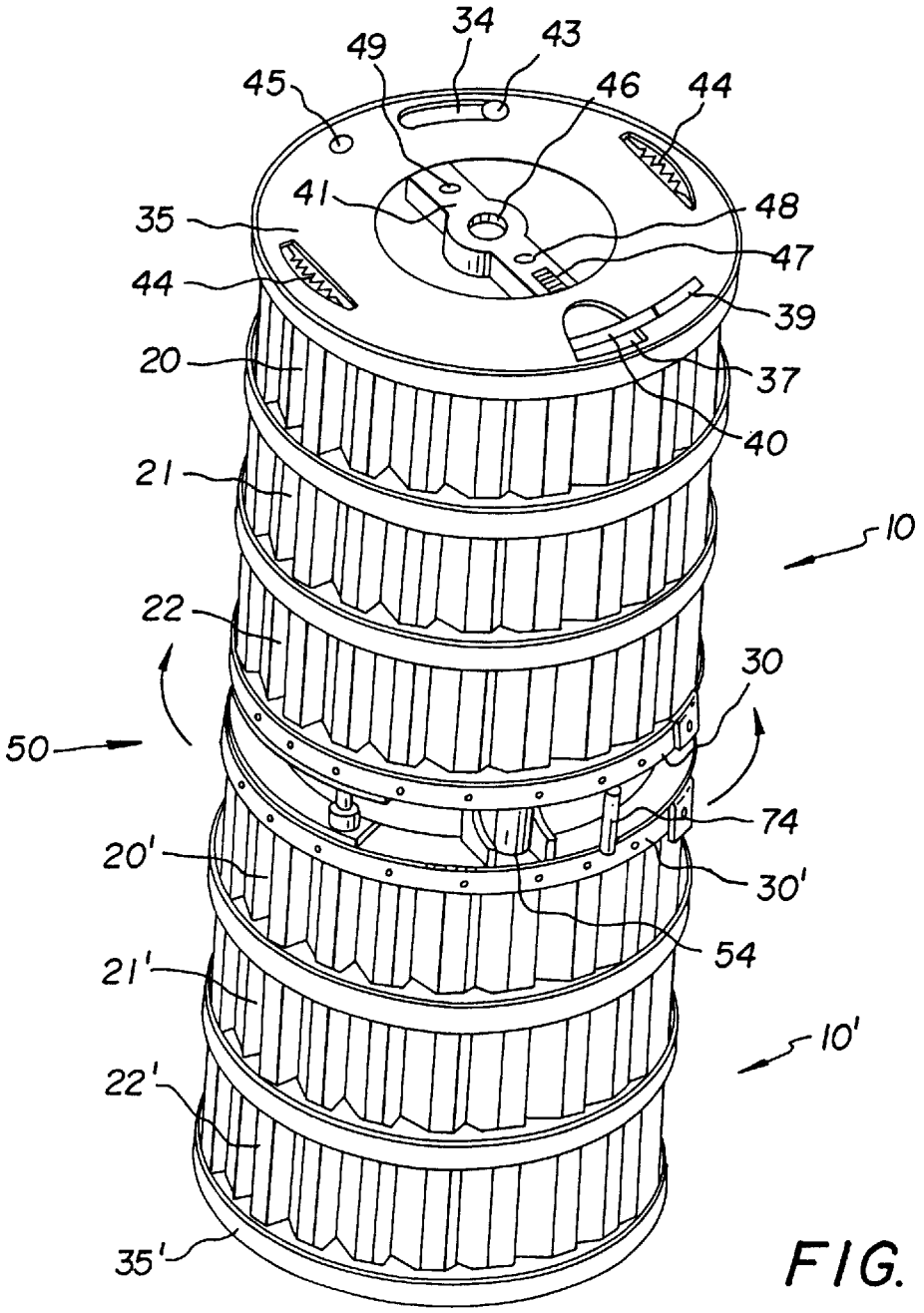
FIG. 1 is the magazine arrangement according to the invention in a vertical position in a perspective view.
Figure 2:
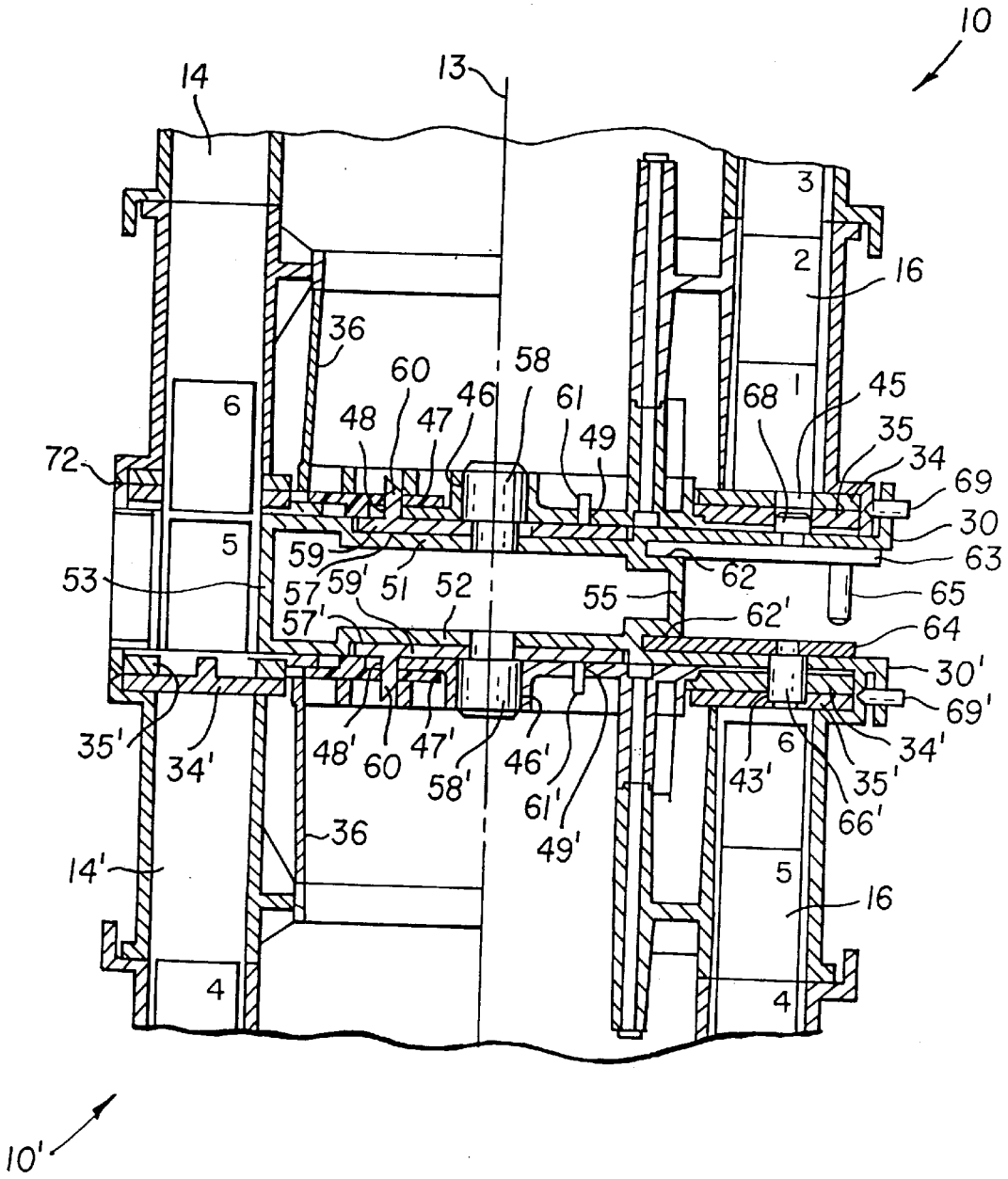
FIG. 2 is the magazine arrangement according to FIG. 1 with the mutually facing ends of two magazines with an adapter arranged between them in cross-section.
Figures 3, 4:
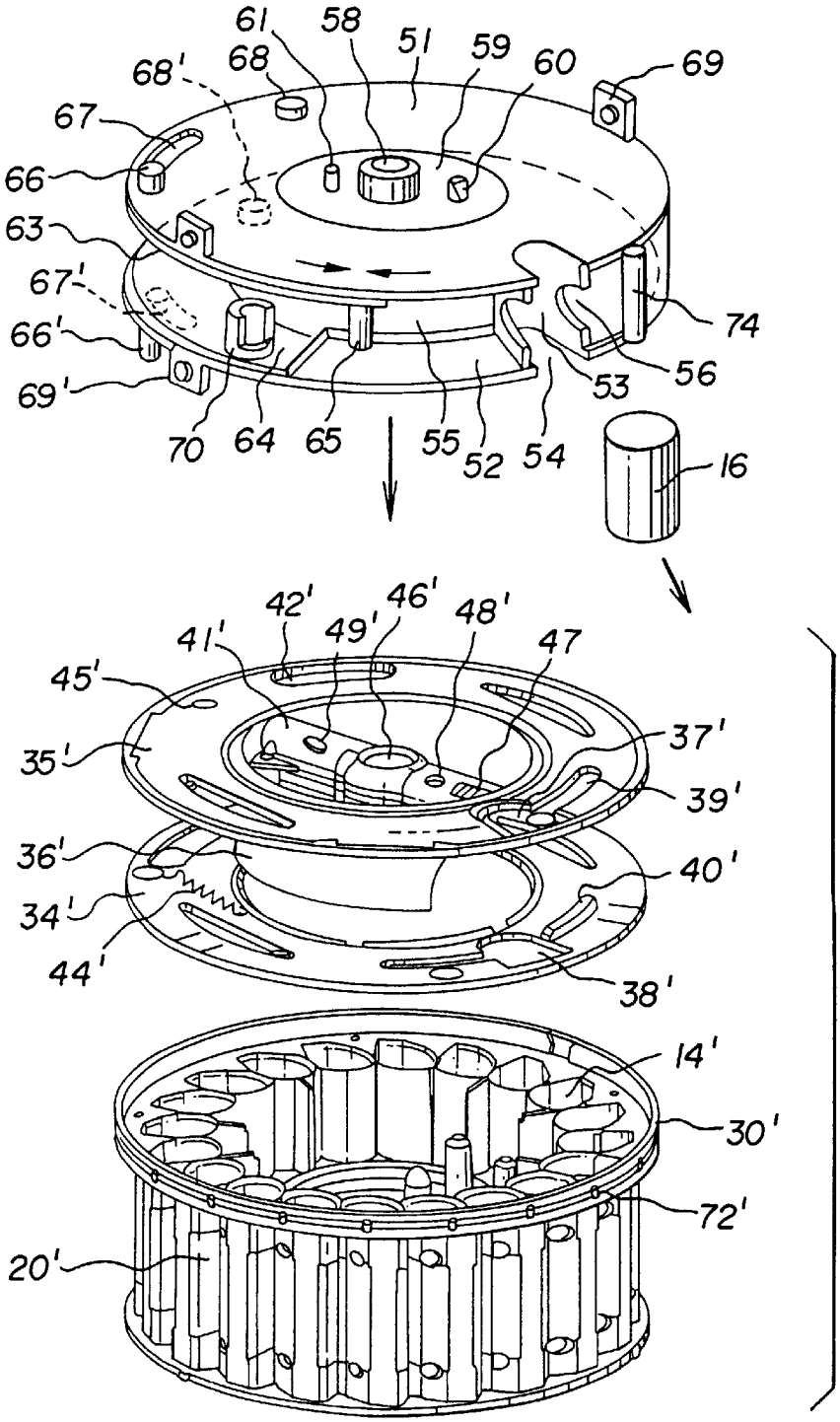
FIG. 3 is an adapter according to the invention according to FIGS. 1 and 2 in a perspective view.
FIG. 4 a partial magazine of the magazine arrangement according to FIG. 1 with the closure disks in an illustrative exploded depiction.

For the development of exposed films, the individual filmstrips are removed from the film cartridges and spliced together, and wound onto a film drum that is inserted into a developing machine. In order to automate the splicing process, a magazine for receiving a plurality of film cartridges was developed. This magazine 10 is attached to a splicer apparatus either in the vertical position or in the horizontal position. The filmstrips are removed from the film cartridges and processed by means of a mechanism that is not depicted.

It is conceivable that after processing of the filmstrips, the latter are put back into the corresponding film cartridges, which are then conveyed, together with the mailing envelopes and finished prints, to a final processing system or delivery point.

Magazine 10 consists of a cylindrical member in which chambers 14 are arranged, separated from one another, circularly around member center axis 13. Film cartridges 16 are housed, layered one above another, in chambers 14, in such a way that their film slots are turned radially outward.

In the embodiment, cylindrical magazine 10 consists, for production-engineering reasons, of three submagazines 20, 21, and 22, the height of which is such that there is room in each for two film cartridges 16 one above another. The three submagazines 20, 21, and 22 are immovably joined to one another by screws (not depicted).

The free ends of magazine 10 are each covered by an inner and an outer closure disk 34 and 35, which are mounted, rotatably with respect to one another about member center axis 13, on a cup-shaped hub 36 retained in magazine 10 and a magazine outer ring 30. The two closure disks 34 and 35 are forced into their closed starting position with respect to one another by means of tension springs 44. To open a chamber 14 in order to insert or remove film cartridges 16, the two closure disks 34, 35 are rotated with respect to one another until an insertion opening 37 of outer closure disk 35 is coincident with a passthrough opening 38 of inner closure disk 34 exactly above a chamber 14. Stops limit the movement of the closure disks.

A curved sliding guide consists of a groove 39 in outer closure disk 35 and a web 40 on inner closure disk 34. This configuration on the one hand allows easy rotation of closure disks 34 and 35, and on the other hand web 40 prevents film cartridges 16 from falling into insertion opening 37 of outer closure disk 35, since web 40 has the same height as outer closure disk 35. Web 40 also serves as a stop when closure disks 34 and 35 are forced by springs 44 into their starting position.

In addition, an elongated hole 42 arranged concentrically with member center axis 13, through which, when closure disks 34 and 35 are in their starting positions, a cylindrical depression 43 in inner closure disk 34 is freely accessible, is provided in outer closure disk 35. An orifice 45 is present in outer closure disk 35 parallel to member center axis 13.

A transport handle 41 is provided transversely across the open diameter of hub 36 so that magazine 10 can be handled easily. Provided in transport handle 41 are a central bearing orifice 46, a displaceable lock 47, an unlocking hole 48, and a polarity orifice 49.

An adapter 50 is provided for the eventuality that film cartridges 16 are to be transferred, individually or chamber by chamber, from one magazine 10 into another; or that, for example, defective film cartridges 16 must be removed individually from magazine 10.

This adapter 50 is equipped with means which allow two magazines to be coupled together and allow closure disks 34 and 35 to be opened and closed in order to transfer or remove film cartridges 16.

Adapter 50 is annular in configuration, and has on the one hand the same diameter as a magazine 10, and has a height that corresponds substantially to the length of a film cartridge 16.

Adapter 50 consists in detail of a circular upper plate 51 and a lower plate 52 of the same shape and size, which are rigidly interconnected by means of a web segment 55 arranged concentrically with member center axis 13. A further immovable connection between upper plate 51 and lower plate 52 is created by a wall 53, arranged parallel to member center axis 13, which forms a transfer chamber 54 open radially to the outside. Transfer chamber 54 has in cross-section the same shape and size as one chamber 14 of a magazine 10. Access openings 56, open radially to the outside, are configured in the mutually opposite wall parts of wall 53 which forms transfer chamber 54. A cover slider 74, guided displaceably in upper plate 51 and lower plate 52 on the outside of adapter 50, closes off transfer chamber 54 or uncovers it as necessary.

Provided in both upper plate 51 and in lower plate 52 are centrally located depressions 57, in each of which a pivot pin 58 is immovably arranged on member center axis 13. Located in each depression 57 is a bearing disk 59, which is held by pivot pin 58 and is rotatable about it. An unlocking pin 60 and a polarity pin 61 are arranged on each bearing disk 59.

Configured in each case between web segment 55 and both upper plate 51 and lower plate 52 is a guide groove 62 arranged concentrically with member center axis 13. Arranged rotatably about member center axis 13 in the one guide groove 62 is an upper segment element 63 , and in the other guide groove 62' a lower segment element 64.

Upper segment element 63 has a peg-shaped stop 65 which extends toward lower plate 52, and it carries a pin 66 which passes through an elongated hole 67 arranged in upper plate 51 concentrically with member center axis 13.

In addition, a peg 68 and a elastically arranged snap pin 69 are provided on the outward-facing surfaces of upper plate 51 and lower plate 52.

Lower segment element 64 carries a counterstop 70, which is hemicylindrical in configuration and is mounted rotatably. Also provided on lower segment element 64 is a pin 66' that passes through an elongated hole 67' present in lower plate 52.

The magazine arrangement operates as follows:

To process exposed films in a film developing machine, the filmstrips are first spliced together in a splicer apparatus, and then wound into a roll. For this purpose, the film cartridges filled with film are inserted into chambers 14 of a magazine 10. This full magazine 10 is joined to an empty magazine 10' with adapter 50 interposed. The resulting magazine arrangement is then attached to the splicer apparatus.

During assembly of the magazine arrangement, adapter 50 is first placed on the empty magazine 10' in the zero position. In the process, bearing pin 58' of lower plate 52 engages into bearing orifice 46' of transport handle 41' of the empty magazine 10'. In addition, unlocking pin 60' projects into unlocking hole 48' and unlocks displaceable bolt 47' so that inner closure disk 34' is free to rotate. Polarity pin 61' enters polarity orifice 49'.

In addition, peg 68' of lower plate 52 engages into orifice 45' of outer closure disk 35', and pin 66' of lower segment element 63 penetrates into cylindrical depression 43' of inner closure plate 35'. Snap pin 69' thus snaps into one of snap depressions 72' provided on magazine outer ring 30'.

The full magazine 10 is then placed on adapter 50 on its upper plate 51, in such a way that it is in a zero position in which insertion opening 37' of magazine 10' and insertion opening 37 of magazine 10, and transfer chamber 54 of adapter 50, are located in alignment above one another. Bearing pin 58 thus engages into bearing orifice 46 or hub 36 and unlocking pin 60 into unlocking hole 48. Peg 68 on upper plate 51 enters orifice 45 of outer closure disk 35, and pin 66 enters cylindrical depression 43 of inner closure disk 34. Snap pin 69 snaps into a snap depression 72 on magazine outer ring 30. Correlation between transfer chamber 54 and chambers 14 and 14' of magazines 10 and 10' is thus ensured.

In this state, magazines 10 and 10' and adapter 50 are functionally interconnected. Adapter 50 is positively joined by means of its peg 68 and pin 66 to closure disks 35 and 34, respectively, and it is free to rotate in both directions.

Figure 5:
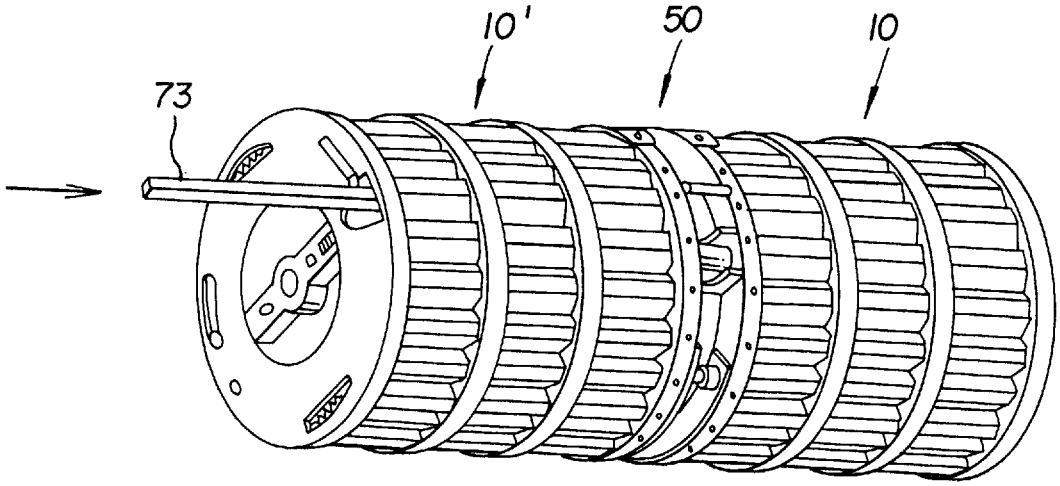
FIG. 5 is the magazine according to FIG. 1 in a horizontal position in a perspective view.
Figure 6:
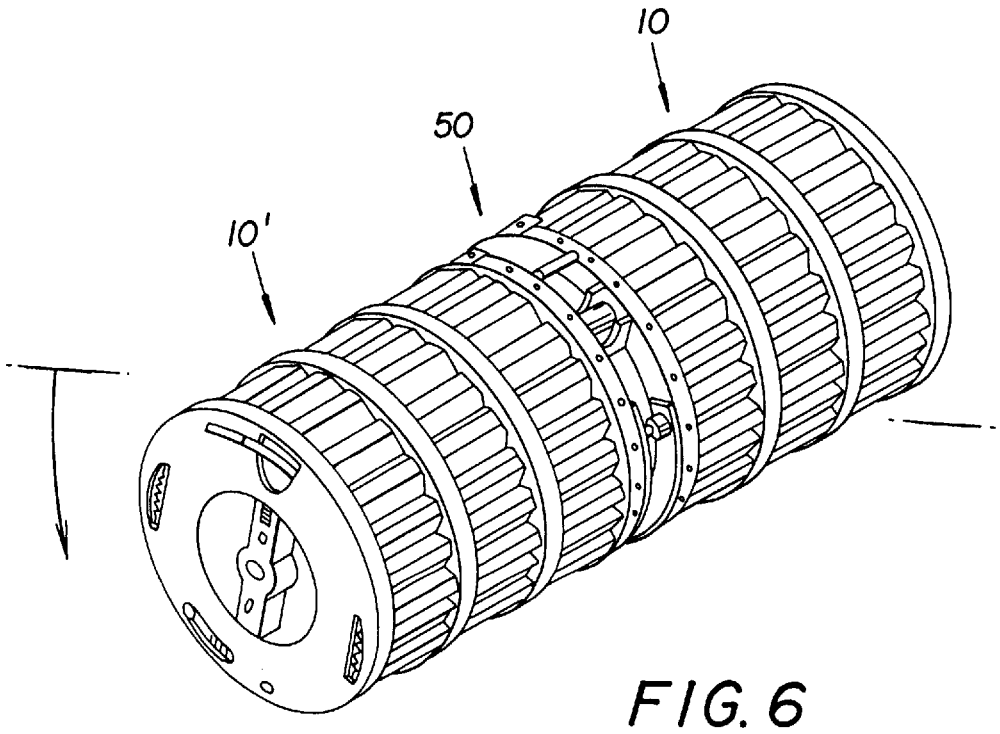
FIG. 6 is the magazine arrangement according to FIG. 1 in a tilted position in a perspective view.

If a column of six film cartridges 16 located one above another in a chamber 14 is to be transferred from magazine 10 into magazine 10', peg-shaped stop 65 and thus upper segment element 63, as well as counterstop 70 and thus the lower segment element, are moved with respect to one another until they touch. As a result, passthrough openings 38, 38' on the two magazines 10 and 10' come into coincidence with insertion openings 37, 37' and transfer chamber 54, so that the column of six film cartridges 16 falls under its own weight from magazine 10 into magazine 10'. When the magazine arrangement is arranged horizontally, as depicted in FIG. 5, a pusher 73 is used to transfer film cartridges 16.

Rotation of inner closure disks 34, 34' is implemented by pins 66, 66' which engage into cylindrical depressions 43, 43' of inner closure disks 34, 34'.

During this transfer process, stop 65 is prevented from returning to its starting position by a 180-degree rotation of hemicylindrical counterstop 70. Once film cartridges 16 have been transferred, counterstop 70 is rotated back 180 degrees, and stop 65 is released. In response to the force of tension spring 44, upper and lower segment elements 63 and 64, and thus inner closure disks 34 and 34' respectively, pivot back into their starting positions in which insertion openings 37 and 37' are closed off.

If one defective film cartridge 16 is to be removed from magazine 10, adapter 50 is first rotated until its transfer chamber 54 is located below chamber 14 of magazine 10 in which the defective cartridge is located. Then inner closure disk 34 of magazine 10 is rotated until passthrough opening 38 is coincident with insertion opening 37, by moving stop 65 and thus upper segment element 63 with pin 66 in the direction of arrow "C". The lowest film cartridge (1) of the column falls into transfer chamber 54. The film cartridge (2) above it moves into the region of outer closure disk 35. When stop 65 is released, upper segment element 63 with stop 65, and inner closure disk 34, attempt to return to their starting position in response to the force of tension spring 44. The film cartridge located in the region of outer closure disk 35 prevents this, however, and in the process is wedged in place. In this manner the remaining column of film cartridges (2) to (6) is held in this position.

Film cartridge 16 located in transfer chamber 54 is then released by the fact that counterstop 70 and thereby lower segment element 64 are moved in the direction of arrow "D" and inner closure disk 34' of magazine 10' is opened via pin 66', and the film cartridge falls into one of chambers 14' of magazine 10'. After counterstop 70 is released, inner closure disk 34' returns to its closed position.

This procedure is repeated, by alternate opening and closing of inner closure disks 34 and 34', until the defective film cartridge is located in transfer chamber 54. After cover slider 74 is opened, access can be obtained to transfer chamber 54 through access opening 56, and the defective film cartridge can be removed.

After repair of the defective cartridge or insertion of an empty cartridge, cover slider 74 is closed again, and stop 65 and counterstop 70 are moved toward one another and locked together by a 180-degree rotation of counterstop 70. The magazine arrangement is then turned upside down so that film cartridges 16 fall back out of magazine 10' into magazine 10 under their own weight, or the film cartridges are pushed back into magazine 10 using pusher 73.

We claim:

1. A magazine arrangement for receiving multiple film cartridges for processing of filmstrips present in the film cartridges, said magazine arrangement comprising:

a first cylindrical magazine member having a plurality of chambers, said chambers being circumferentially arranged in a circle around a central axis of said first cylindrical magazine member, so as to permit the film cartridges to be housed axially one above another within said chambers and provide for axial movement of the film cartridges through each of said chambers, each free end of the first cylindrical magazine member being covered by two superimposed closure disks that are mounted rotatably with respect to one another about the central axis, said superimposed closure disks being spring biased to a closed position and when rotated to an open position the closures disks form an opening for insertion or removal of a film cartridge from one of said chambers in the axial direction; and an adapter which joins the first cylindrical magazine member to a second cylindrical magazine member having a plurality of chambers and two second superimposed closure disks, said second superimposed closure disks being spring biased to a closed position and when rotated to an open position the second closure disks form an opening for insertion or removal of a film cartridge from one of the chambers of the second cylindrical magazine member in the axial direction, said adapter comprising means for engaging with the superimposed closure disks of the first cylindrical magazine member and the second superimposed closure disks of the second cylindrical magazine member, said adapter having a transfer chamber having a configuration for allowing the film cartridges to pass to and from said first and second cylindrical magazines members through a respective opening formed by rotation of said closures disks and an access opening for removing or inserting one of said film cartridge from said adapter in the substantially radial direction.

2. A magazine arrangement according to claim 1, wherein the adapter is of annular configuration, and has a height which corresponds substantially to a length of an individual film cartridge of said film cartridges.

3. A magazine arrangement according to claim 1, wherein the adapter comprises an upper plate and a lower plate which are rigidly interconnected by means of a concentrically arranged web segment, and by means of a wall forming a transfer chamber that is open radially outward.

4. A magazine arrangement according to claim 3, wherein each of the upper plate and the lower plate of the adapter comprises a centeredly mounted pivot pin, an outward-facing central depression into which the pivot pin projects, and a bearing disk rotatably arranged about the respective pivot pin in each central depression.

5. A magazine arrangement according to claim 4, wherein an unlocking pin and a polarity pin are provided on each bearing disk, said unlocking pin and said polarity pin extending toward a cylindrical magazine member that is to be attached, the unlocking pin acting upon a magazine-mounted lock that engages in an outer closure disk of said superimposed closure disks or said further superimposed closure disks.

6. A magazine arrangement according to claim 3, wherein the transfer chamber formed by the wall has in cross-section a shape and size of the chambers of the cylindrical magazine member.

7. A magazine arrangement according to claim 3, wherein a first guide groove is configured between the web segment and the upper plate, the first guide groove being concentrically arranged with respect to the central axis, wherein an upper segment element is mounted slidingly about the central axis.

8. A magazine arrangement according to claim 7, wherein a peg-shaped stop that extends toward the lower plate is mounted on the upper segment element, and a first pin which passes through an elongated hole arranged in the upper plate is provided on the upper segment element, such that when the cylindrical magazine member is attached, the pin engages into an inner closure disk of said superimposed closure disks.

9. A magazine arrangement according to claim 8, wherein a second guide groove is configured between the web segment and the lower plate, the second guide groove being concentrically arranged with respect to the central axis, wherein a lower segment element is mounted slidingly about the central axis.

10. A magazine arrangement according to claim 9, wherein a hemicylindrical counterstop, which extends toward the upper plate in a region of the peg-shaped stop, is arranged rotatably on the lower segment element, and a second pin which passes through an elongated hole arranged concentrically in the lower plate is provided on the lower segment element, such that when the cylindrical magazine member is attached, the second pin engages into an inner closure disk of said further superimposed closure disks.

11. A magazine arrangement according to claim 10, wherein the counterstop is rotatable through 180 degrees and thereby surrounds the peg-shaped stop in such a way that it is locked, so that the superimposed closure disks and the further superimposed closure disks of the two coupled cylindrical magazine members are in their open position, and one chamber of the cylindrical magazine member and one chamber of the further cylindrical magazine member are continuously joined via the transfer chamber of the adapter.

12. A magazine arrangement according to claim 9, wherein the upper and lower segment elements are each movable against a spring force out of their rest position, in such a way that the peg-shaped stop comes into contact with the counterstop.

13. A magazine arrangement according to claim 3, wherein the wall forming the transfer chamber has at least one access opening open radially to the outside.

14. A magazine arrangement according to claim 3, wherein the radially outward-oriented opening of the transfer chamber can be covered or uncovered by means of a cover slider mounted in the upper plate and the lower plate.

15. A magazine arrangement according to claim 3, wherein an elastic snap pin which, when the cylindrical magazine member and the further cylindrical magazine member are attached, engages into snap depressions arranged on an outer ring of each of the cylindrical magazine member and the further cylindrical magazine member, is provided on the upper plate and the lower plate of the adapter.

16. A magazine arrangement according to claim 3, wherein when a first film cartridge is present in the transfer chamber, a second film cartridge located above the first film cartridge is in a region of an insertion opening of an outer closure disk of the superimposed closure disks, and is held in locked fashion by a spring-loaded inner closure disk of the superimposed closure disks.

* * * * *